United States Patent [19]

Wall

[11] Patent Number: 5,052,487

[45] Date of Patent: Oct. 1, 1991

[54] SEQUENTIAL INJECTION FOAM PROCESS FOR ENHANCED OIL RECOVERY

[75] Inventor: Robert G. Wall, Pinale, Calif.

[73] Assignee: Chevron Research & Technology Company, San Francisco, Calif.

[21] Appl. No.: 459,091

[22] Filed: Dec. 29, 1989

[51] Int. Cl.[5] ..... E21B 43/22; E21B 43/24

[52] U.S. Cl. ..... 166/263; 166/272; 166/274; 166/303

[58] Field of Search ..... 166/272, 273, 274, 303, 166/263

[56] References Cited

U.S. PATENT DOCUMENTS

| | | | |
|---|---|---|---|
| 3,608,638 | 9/1971 | Terwilliger | 166/272 |
| 3,946,810 | 3/1976 | Barry | 166/272 |
| 4,086,964 | 5/1978 | Dilgren et al. | 166/272 |
| 4,127,170 | 11/1978 | Redford | 166/272 X |
| 4,161,217 | 7/1979 | Dilgren et al. | 166/272 X |
| 4,393,937 | 7/1983 | Dilgren et al. | 166/272 |
| 4,556,107 | 12/1985 | Duerksen et al. | 166/273 X |
| 4,576,232 | 3/1986 | Duerksen et al. | 166/274 |
| 4,607,700 | 8/1986 | Duerksen et al. | 166/303 |
| 4,682,653 | 7/1987 | Angstadt | 166/303 |
| 4,697,642 | 10/1987 | Vogel | 166/263 |

*Primary Examiner*—George A. Suchfield

*Attorney, Agent, or Firm*—Burns, Doane, Swecker & Mathis

[57] ABSTRACT

This invention provides a method for enhanced oil recovery which comprises two steps. In the first step, an oil-mobilizing agent comprising (a) a gas and an alkyl aromatic sulfonate or (b) an organic solvent is injected into the reservoir formation sufficient to reduce the oil concentration in at least a portion of the formation. Then in the second injection, steam and an oil-sensitive surfactant effective in forming a steam blocking foam in formations of lower oil concentration. Preferred oil-sensitive surfactants are alpha-olefin sulfonate dimer or alpha-olefin sulfonate surfactants used to form a foam in the oil depleted portions of the formation and to assist the movement of steam and hydrocarbons through the higher oil concentration portions of the formation. The stepwise enhanced recovery method of this invention provides increased efficiency by moving the higher concentration of oil through the formation with an organic solvent or with an alkyl aromatic sulfonate, then moving the lower concentrations of oil through the formation with the steam foam comprising alpha-olefin sulfonate dimer or alpha-olefin sulfonate surfactants.

14 Claims, 4 Drawing Sheets

SEQUENTIAL INJECTION FOAM PROCESS FOR ENHANCED OIL RECOVERY

FIELD OF THE INVENTION

The present invention relates to enhanced oil recovery from a petroleum-bearing formation. More particularly, this invention relates to an improved method of steam stimulation, or steam drive, of petroleum from such a formation wherein foam-forming surfactants are injected into a well along with steam.

BACKGROUND OF THE INVENTION

It has been postulated that steam or gas and surfactant coact with liquid water and formation fluids to form foam which tends to block highly permeable channels that may allow "fingering" or "gravity override" of the steam through the formation. In a mature steam drive, residual oil saturations ($S_{or}$) are frequently less than 15% in the highly permeable steam override zones or channels. In these circumstances, it is desirable to divert the steam from the oil-depleted, high permeability channels into the less permeable zones having high oil saturations. The best foaming agent for these cases foams in the oil depleted channels but does not foam and block access to the zones having high oil saturations. Examples of surfactants with these properties are provided in U.S. Pat. No. 4,556,107, which surfactants can be very effective for diverting steam from oil depleted channels into zones with high oil saturations as long as conditions are suitable for generating a foam in the oil-depleted high permeability channels. It is beneficial for said foams to be very oil sensitive, so that foaming does not occur where oil saturations are high and block steam access to the high oil zones. However, this same beneficial oil sensitivity can be a disadvantage when pockets or localized areas of high oil saturations are present within the generally oil-depleted, high permeability channels, because those pockets or localized areas of high oil can interfere with foam generation and even prevent the development of the steam diverting foam.

It is an objective of this invention to provide a process which helps assure diversion of steam from the high permeability channels into zones having higher oil saturation, even when localized pockets of high oil saturations occur in the high permeability channels.

Steam stimulation of petroleum-bearing formations, or reservoirs, has become one of the preferred methods of enhanced oil recovery. This is because steam is a cost-effective means to supply heat to low-gravity, high viscosity oils. Heat reduces resistance of oil flow from a reservoir to a producing well over a wide range of formation permeabilities. Further, such steam injection enhances the natural reservoir pressure, above that due to the hydrostatic head, or depth-pressure gradient, to increase the differential pressure between oil in the reservoir and the producing well bore.

The producing well may be the same well through which steam is periodically injected to stimulate petroleum flow from the reservoir (popularly called "huff and puff"). Alternatively, one or more producing wells may be spaced from the injection well so that the injected steam drives petroleum through the reservoir to at least one such producing well.

Almost all earth formations which form petroleum reservoirs are created by sedimentary deposition, with subsequent compaction or crystallization of the rock matrix. Such deposition of detrital materials, with varying composition and over extensive geological times, occurs at varying rates. The resulting compacted rocks in which petroleum accumulates are permeable, but in general the flow paths are quite heterogeneous. Accordingly, a petroleum reservoir formed by such rock formations is inherently inhomogeneous as to both porosity and permeability for fluid flow of either native (connate) or injected fluids. Furthermore, flow permeability for connate gas, oil and water is substantially different for each liquid or mixture. Because of these differences in permeability, it is common practice to inject foam forming surfactants with the injected steam to block the more permeable gas passages that may develop in the formation. The desired result is to divert steam from the more permeable gas passageway to less permeable oil-rich zones of the reservoir. The foaming component is usually an organic surfactant material.

This invention is an improvement over prior methods of using foam-forming compositions to enhance petroleum production from oil-bearing formations. A number of these prior methods are mentioned and discussed in U.S. Pat. Nos. 4,086,964, 4,393,937, 4,532,993 and 4,161,217.

The need for surfactants which foam in the presence of both oil and water has been known for some time. Bernard ("Effect of Foam on Recovery of Oil by Gas Drive", *Production Monthly*, 27 No. 1, 18–21, 1963) noted that the best foaming surfactants for immiscible displacements such as steam floods are those which foam when both oil and water are present. However, Duerksen, et al. in U.S. Pat. No. 4,556,107 recognized the advantage of using a selective foaming agent which functions as a steam diverter, foaming in the oil depleted zones but not in the high oil saturation zones where the foam would block access of the steam to the oil. Suitable surfactants for foaming in the presence of both oil and water are the branched alkyl aromatic sulfonate surfactants described in copending application U.S. Ser. No. 07/055,148, filed May 28, 1987, now abandoned. The alpha-olefin sulfonate dimer (AOSD) surfactants of U.S. Pat. No. 4,556,107 are also suitable selective foaming agents for providing steam diversion. Typically these two types of surfactants are used under different circumstances. The steam diversion surfactants of U.S. Pat. No. 4,556,107 are used to counteract channeling and override where oil saturations in the high permeability channels are typically less than about 15% of the available pore space. These conditions are usually encountered in mature steam floods where the channels have been steamed to low oil saturations. The oil-tolerant surfactants of U.S. Ser. No. 07/055,148 are used for improving oil recovery from steam floods where the oil saturations in the channels are approximately 15% or higher. These conditions can occur in young steam floods or in channels which can be resaturated with oil by gravity drainage.

The present invention provides a process for achieving efficient steam diversion over a wide range of oil saturation levels. The process of this invention overcomes the disadvantages of the oil-sensitive surfactants, such as the alpha-olefin sulfonate dimers of U.S. Pat. No. 4,556,107, without sacrificing the efficient steam diversion properties these surfactants provide. This invention, therefore, provides a means to enhance the performance of the alpha-olefin sulfonate dimers in enhanced oil recovery operations. This invention also makes it unnecessary to use separate oil-tolerant surfactants.

The above-mentioned patents and applications are incorporated herein by reference.

SUMMARY OF THE INVENTION

In one aspect, this invention is a method of enhanced recovery of oil from a petroleum reservoir comprising:

injecting into said reservoir an oil-mobilizing agent comprising (a) a gas and a surfactant or (b) an organic solvent, which agent is capable of mobilizing oil present in oil-bearing formation in said reservoir, in an amount sufficient to reduce the oil concentration in said oil-bearing formation;

stopping the injection of the oil-mobilizing agent; and injecting into said formation steam and an alpha-olefin sulfonate dimer surfactant or an alpha-olefin sulfonate surfactant sufficient to form a foam in areas of reduced oil concentration and thereby divert steam from said areas to areas of said oil-bearing formation having higher oil concentration thereby assisting in the movement of oil through said formation and in the recovery of hydrocarbons from said reservoir.

In another aspect this invention provides an improved process for enhancing petroleum recovery from a petroleum reservoir using steam. The process of this invention comprises a first injection of a composition comprising a chemical agent to mobilize oil and reduce the residual oil concentration to low levels, e.g., less than about 15% of the pore space, and a second injection of a foaming agent to provide diversion of the steam from the high permeability channels into the zones at high oil saturation. Preferably the steam is partially wet to assist the formation of foam.

In one preferred aspect, the chemical agent useful in the first injection for reducing the residual oil saturation is a surfactant solution containing an alkyl aromatic sulfonate with an equivalent weight of at least about 400. Especially preferred are the linear or branched alkyl benzene or toluene sulfonates with equivalent weights from about 450 to about 600. The branched alkyl aromatic sulfonates of co-pending application U.S. Ser. No. 07/055,148 are also suitable surfactants for reducing the oil saturation in the first step of the process of this invention. Such surfactants are especially effective for reducing the oil saturations to levels which allow an oil-sensitive steam diverting foam to work well in the second injection according to this invention.

In another preferred aspect, the chemical agent useful in the first injection for reducing the residual oil saturation is a hydrocarbon solvent containing from 3 to about 20 carbon atoms. Especially preferred are the aromatic hydrocarbons such as benzene, toluene, and xylene. These organic solvents are also especially effective for reducing oil saturations to a level which allow an oil-sensitive steam diverting foam to work well in the second injection according to this invention.

The foaming agents useful in the second injection include alpha-olefin sulfonates prepared from alpha-olefins in the C16–C24 range. These alpha-olefin sulfonates are oil sensitive foaming agents that do not foam where residual oil levels are high but do form effective foam blocking where oil levels are low. In a more preferred aspect, the foam forming component used in the second injection of the process of this invention include alpha-olefin sulfonate dimers (AOSD). These AOSD surfactants have been shown to be superior steam diverting agents for high permeability channels where oil saturations are less than about 15% of the pore space.

DESCRIPTION OF THE INVENTION

Figure 1:
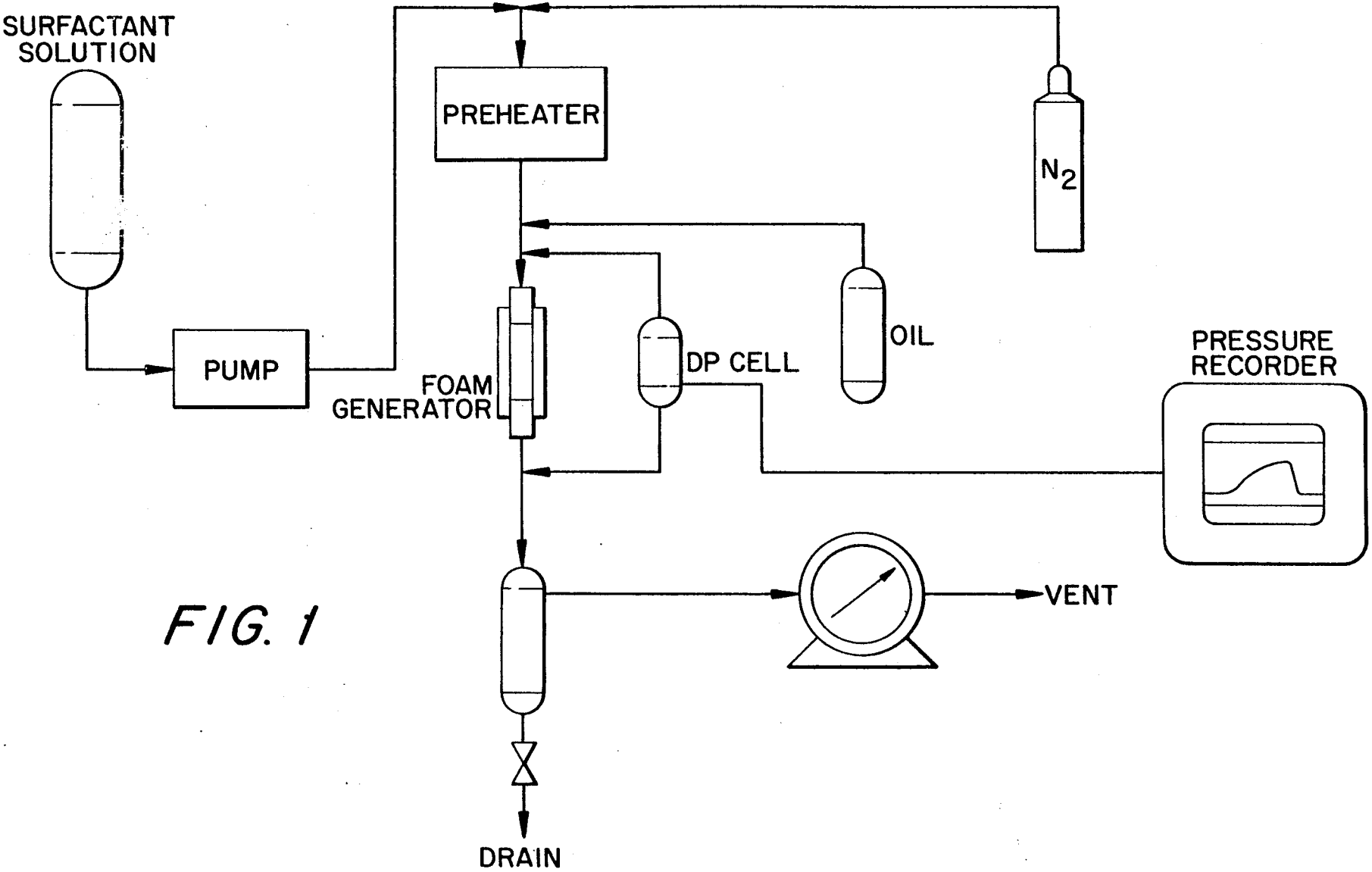
FIG. 1 is a schematic diagram of the test equipment employed in Example I.

The two-stage process of the present invention provides increased efficiency and cost effectiveness of enhanced oil recovery using steam-foam drive media. The alpha-olefin sulfonate dimer and alpha-olefin sulfonate surfactants used in the second step of the present invention are particularly preferred and particularly effective steam-foam drive medium forming agents in that they are uniquely effective in diverting steam from breakthrough areas in the formation and forcing the steam to sweep through other portions of the formation to recover additional hydrocarbons. The optimal effectiveness of these surfactants, particularly the alpha-olefin sulfonate dimer surfactants, is realized when the oil concentration in the formation of the reservoir is less than about 15%, preferably less than about 10% of the available pore volume. At oil concentrations higher than about 15% the alpha-olefin sulfonate dimer surfactants are slow to form the steam-foam drive media in some formations, and in other formations, the higher concentration of oil in the formation sometimes effectively inhibits the alpha-olefin sulfonate dimers from forming any significant quantity of the desired steam-foam drive medium. Therefore, I have developed the two-step process of the present invention wherein the first step reduces the oil concentration in the formation to less than about 15%, preferably less than about 10%, and wherein in the second step of the process of the present invention then provides the most effective and optimal performance of the alpha-olefin sulfonate dimer and alpha-olefin sulfonate surfactants.

I have determined that in some formations the oil concentration can be reduced to the desired level of 15%, 10% or less using steam, but using steam alone is in many formations a slow and inefficient process. In other formations, steam alone does not reduce the oil concentrations sufficiently to bring the oil concentration into the range for optimum effectiveness in the second step using the alpha-olefin sulfonate dimer or alpha-olefin sulfonate surfactant.

The efficiency and cost effectiveness of reducing the oil concentration in the formation to the desired level of less than about 15% can be achieved according to the present invention by using an oil-mobilizing agent, such as an organic solvent having from about 3 to about 20 carbon atoms or steam and an alkyl aromatic sulfonate surfactant wherein the alkyl group is a straight or branched chain having 18 or more carbon atoms. After using either the organic solvent or the alkyl aromatic sulfonate surfactant in the first step to reduce the oil concentration in the formation to the desired level, then the second step is carried out in accordance with the present invention using the alpha-olefin sulfonate dimer or alpha-olefin sulfonate surfactants.

The organic solvents used in the first step of the present invention are hydrocarbons with 3 to 20 carbon atoms. The hydrocarbons can be aliphatic or aromatic with linear or branched alkyl chains. Mixtures of hydrocarbons are also suitable. Especially preferred are the aromatic hydrocarbons such as benzene, toluene, and xylene or mixtures thereof. Most preferred are toluene and xylene or mixtures thereof. The amount of organic solvent used to reduce the oil concentration in the formation is generally in the range of 0.1 to 3 liquid pore volumes for the zone being cleaned.

The alkyl aromatic sulfonate surfactants used in the first step of the present invention are straight or branched chain C18 or greater alkyl aromatic sulfonates. Preferably, the alkyl aromatic sulfonates are those which have a molecular weight greater than 450 g/eq. Preferably, the alkyl groups have 20 to 24 carbon atoms, either branched or linear. The branched alkyl aromatic sulfonates of co-pending application Ser. No. 07/055,148 filed May 28, 1987 are suitable surfactants for this process.

The surfactant used in the second step of the method of this invention is any surfactant that is effective in forming a foam with steam in reservoir formations having less than about 15% pore volume residual oil concentration. In general, these surfactants are the "oil-sensitive" type, i.e., they are surfactants which will not form foams, or they form foams too slowly to be practical, in the presence of higher residual oil concentrations, usually above about 15% of the pore volume of the formation. Surfactants which are suitable for use in this second step can readily be determined by using the laboratory test method disclosed herein as well as the test methods known in the art. Preferred oil-sensitive surfactants for use in this invention are alpha-olefin sulfonate dimer and alpha-olefin sulfonate surfactants The alpha-olefin sulfonate dimer surfactants useful in the second step of this process include those disclosed in U.S. Pat. Nos. 3,721,707; 4,556,107; 4,576,232; and 4,607,700; the disclosures of which are incorporated herein by reference. The alpha-olefin sulfonates are preferably prepared from C16–C24 alpha-olefins and are also well known in the art and are available. For example, suitable alpha-olefin sulfonates for the second step of the present invention are disclosed in U.S. Pat. Nos. 4,393,937 and 4,532,993, incorporated herein by reference. The oil recovery process disclosed in U.S. Pat. No. 4,532,993 uses an alpha-olefin sulfonate foam which is "chemically weakened" by contact with reservoir oil, which provides one effective method of reducing the oil concentration in the formation to less than about 15% in preparation for initiating the second step of the method of this invention.

It is to be noted that the two steps of the method of this invention are normally performed in sequence. However, the second step can be overlapped with the first step if desired, i.e., the injection of the steam foam —AOS or AOSD mixture can begin before the injection of the oil-mobilizing agent is stopped. This embodiment of the invention could be desired if separate injection wells are used for the first step and for the second step. Such overlapping of the injection steps is normally not desirable, but is within the scope of this invention as set forth in the claims herein.

EXAMPLES

The following abbreviations are used in the examples:

| | |
|---|---|
| AOSD | Alpha-olefin sulfonate dimer defined in U.S. Pat. No. 4,556,107. |
| 1618 AOS | $C_{16}$–$C_{18}$ alpha-olefin sulfonate. |
| 2024 AOS | $C_{20}$–$C_{24}$ alpha-olefin sulfonate. |
| LABS | Linear alkyl benzene sulfonate. |
| BABS | Branched alkyl benzene sulfonate. |
| BATS | Branched alkyl toluene sulfonate. |
| 1030 BABS | $C_{10}$–$C_{30}$ alkyl benzene sulfonate with a branched alkyl side chain. |
| 2024 LATS | $C_{20}$–$C_{24}$ alkyl toluene sulfonate with a linear alkyl side chain. |

EXAMPLE I

This example demonstrates the benefits of using a solvent to reduce the residual oil saturation in the first step of the sequential injection process of this invention. Foam tests were run in a laboratory foam generator packed with steel wool. A schematic diagram of the test equipment is shown in FIG. 1. A synthetic steam generator feed water (SGFW) was used as the aqueous phase for all tests. The SGFW composition is given in Table 1. The foam test conditions and the test sequence are given in Tables 2 and 3. In these tests toluene was used to reduce residual oil levels in the first step to assist foaming in the second step. The test results are given in Table 4. The relative performance was obtained from the response rate and the pressure increase. As shown in Table 4, the response rate was 4–6 times faster and the pressure increase was 40% higher following a solvent wash with less than 3 pore volumes of toluene. The 3 pore volumes of toluene is a maximum value since the hold-up in the lines was not determined. These results show the surprising enhancement of performance provided by the solvent prewash.

TABLE 1

SYNTHETIC STEAM GENERATOR FEED WATER (SGFW)

| | |
|---|---|
| NaCl, mg/l | 295 |
| KCl | 11 |
| $NaHCO_3$ | 334 |
| $Na_2SO_4$ | 61 |

TABLE 2

STEEL WOOL FOAM TEST CONDITIONS

Temperature = 400° F.
Pressure = 500 psi
Nitrogen = 428 SCCM
Liquid = 2 ml/Min. of 0.5% Active in SGF or SGFW alone
Liquid Volume Fraction = 0.037
Surfactant Concentration (At Conditions) = 0.6%
Nitrogen (% of Gas) = 51%
Steam Quality = 17%
Foam (Gas + Liquid) = 45 ml/Min.
Frontal Velocity = 9000 Ft/Day

TABLE 3

STEEL WOOL FOAM TEST SEQUENCE

1. SGFW with flowing oil.
2. SGFW.
3. Solvent Treatment
4. Test sample/SGFW

TABLE 4

SOLVENT CLEANOUT EFFECTS
ASOD - STANDARD TEST CONDITIONS

| Toluene Prewash[1] | Relative Response Rate | Relative Pressure Increase |
|---|---|---|
| None | 1 | 1 |
| 10 ml | 4 | 1.4 |
| 6 ml | 6 | 1.4 |
| 4 ml | 6 | 1.4 |
| 2 ml | 1 | — |

[1]Includes holdup in the lines. 1 pore volume = 1.5 ml.

EXAMPLE II

This example shows the benefits of using an alkyl aromatic sulfonate for the first step of the sequential injection process of this invention. For these tests, the foam generator was a 1 x 6 inch sandpack. The foam test procedure is given in Table 5.

Two different surfactants were used for the first step of the sequential injection process. The first was a C1014C30 alkyl benzene sulfonate (1030 BABS) with a branched side chain. The average molecular weight was about 500, with an average side chain of about $C_{23}$, which side chains were based on propylene oligomers. The 1030 BABS is representative of the type of surfactant disclosed in co-pending application Ser. No. 07/055,148. The second surfactant was a C20–C24 alkyl toluene sulfonate (2024 LATS) with a linear side chain.

Figure 2:
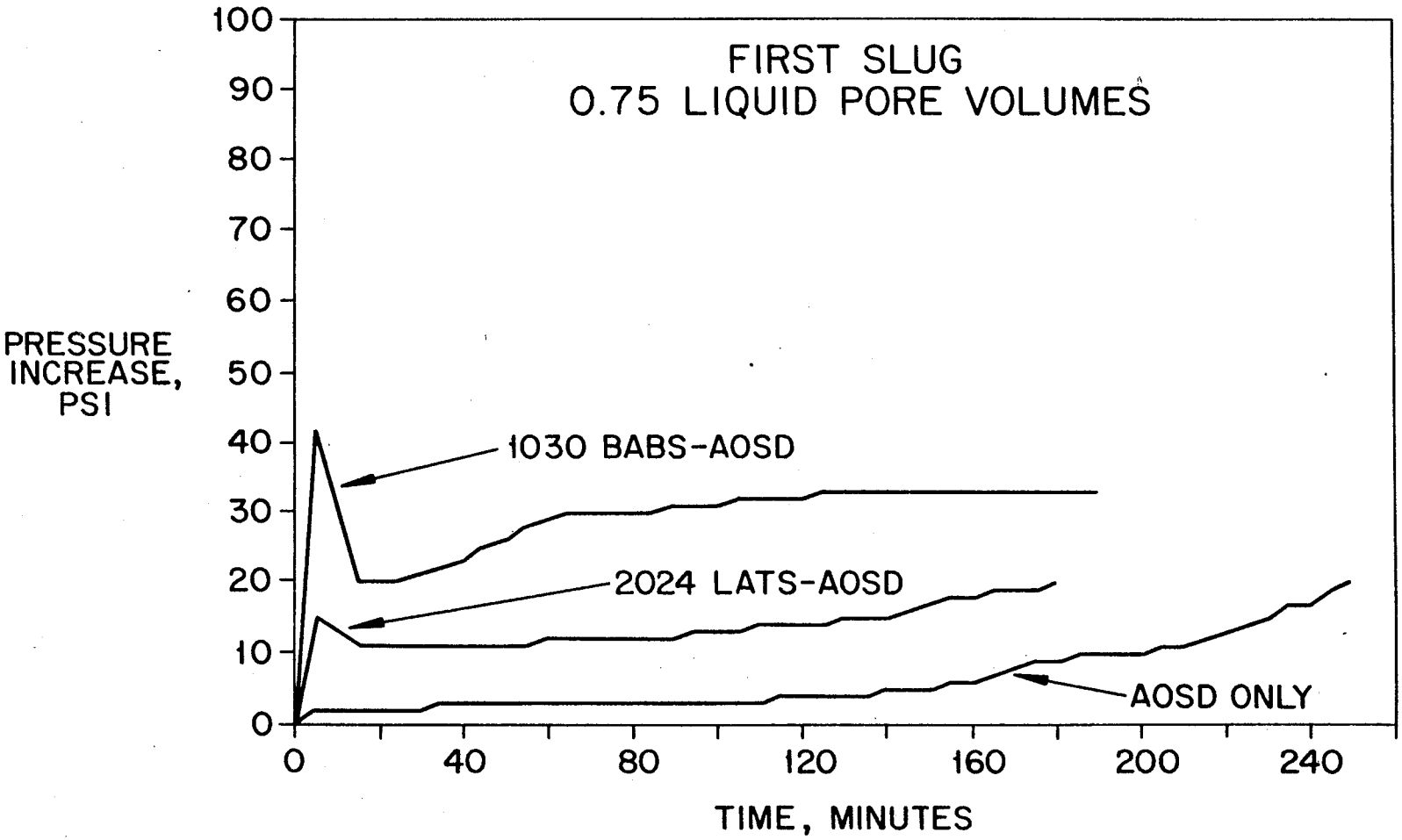
FIG. 2–4 are the results associated with the sand pack foam tests of Example II.
Figure 3:
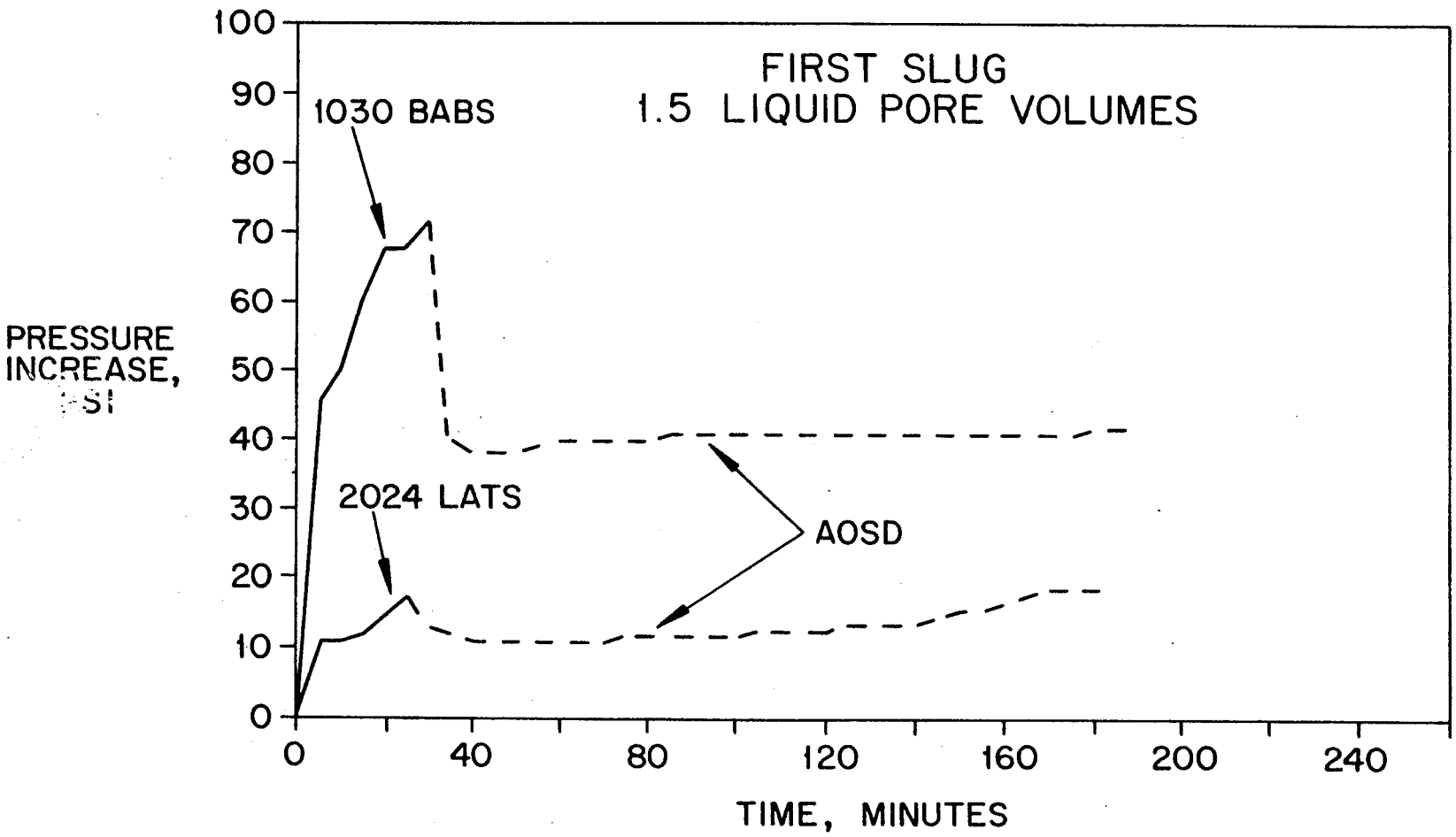
Figure 4:
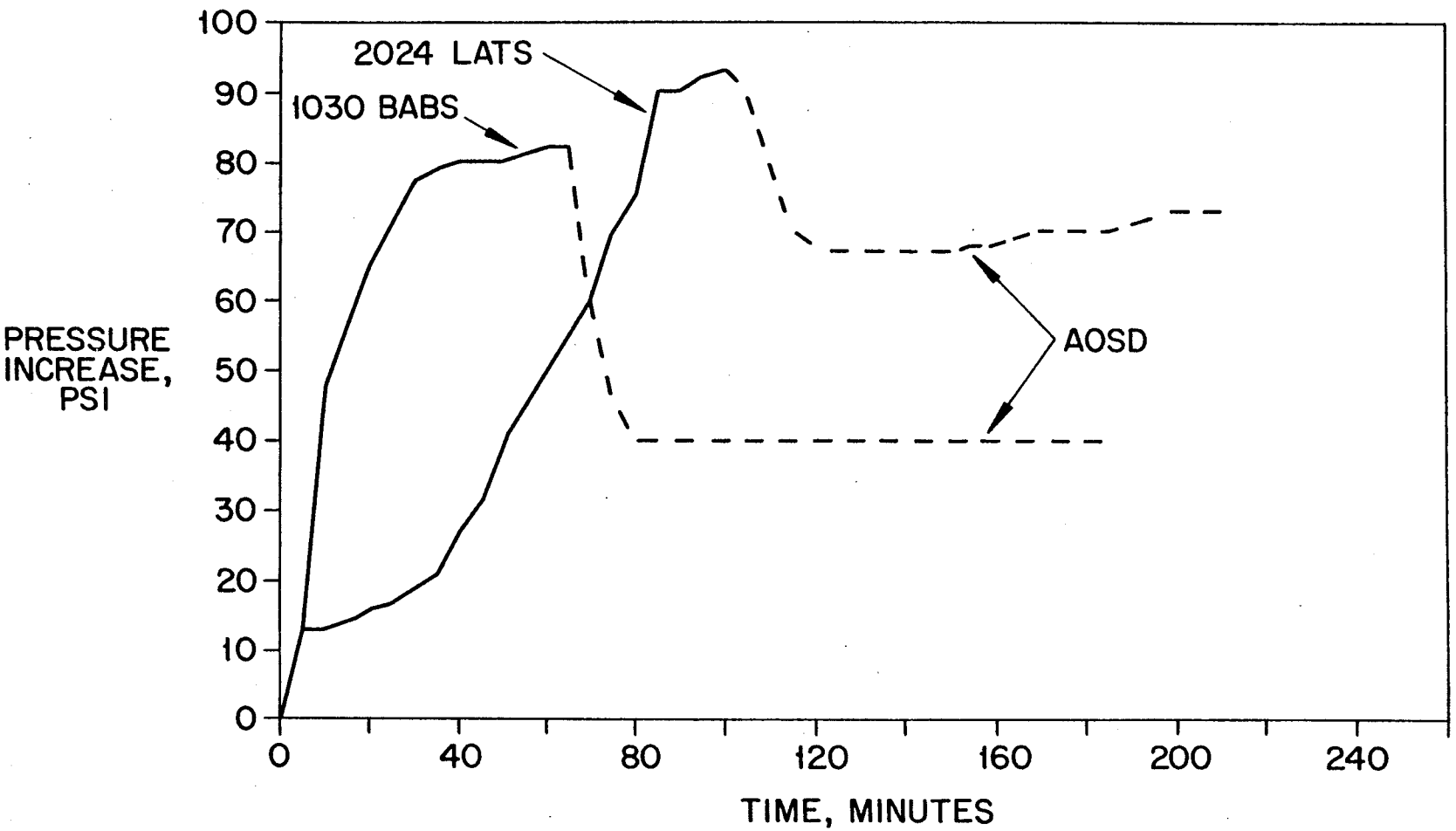

The results from the sandpack foam tests are shown in FIGS. 2 through 4. The test conditions are given on the Figures. FIG. 2 compares AOSD alone to sequential injection experiments were 0.75 of a liquid pore volume of 1030 BABS or 2024 LATS, respectively, were injected prior to AOSD. As shown, the pressure comes up faster and stays higher with the sequential injection process than with the single injection of AOSD. FIG. 3 shows the results with 1.5 liquid pore volumes of the same two first stage surfactants followed by AOSD second stage injection. FIG. 4 shows the results when the same two first stage surfactants are injected until the pressure reaches a plateau before AOSD is injected in the second stage. FIGS. 3 and 4 illustrate that the sequential injection process of the present invention is superior to the single injection of AOSD illustrated in FIG. 2. For example, at 160 minutes the single injection process with AOSD gives a pressure increase of about 8 psi compared to pressure increase ranging from about 15 psi to about 70 psi with the sequential injection of surfactants as shown in FIGS. 2, 3, and 4.

The sequential injection process gives a much greater pressure increase than the single injection process for an equal amount of surfactant injected. These tests show the surprising benefits of using a sequential injection process of the present invention of using a surfactant that is especially effective in reducing oil saturations for the first stage followed by an oil sensitive surfactant with superior steam diversion properties for the second stage.

TABLE 5

SAND PACK FOAM TEST SEQUENCE

1. All steps were carried out at the test temperature/pressure.
2. Saturate the pack with SGFW. (7.0 ml/min.) 50 ml = 50 min.
3. Flow 2.5 liquid pore volumes (1 pv) of crude oil through the pack at a rate of 0.5 ml/min. (50 ml in 100 min.).
4. Flow 4 lpv of SGFW through the pack at 1 ml/min.
5. Start the surfactant solution.
6. Turn on the non-condensable gas (nitrogen) at the chosen rate.
7. Continue until the pressure reaches the plateau maximum.
8. Go back to Step 2 for the next sample.

EXAMPLE III

This example demonstrates that the alpha olefin sulfonates foam well under clean conditions but not with residual oil. It also demonstrates that the alkyl aromatic sulfonates with molecular weights less than 400 are not effective steam foaming agents with or without oil whereas the alkyl aromatic sulfonates with molecular weights above 450 are effective foaming agents with residual oil. The foam tests were run as described in Example I and are shown in Table 6. Measurements are all relative to AOSD with residual oil. The results show that AOSD, 1618 AOS, and 2024 AOS could all be useful for the second step of the sequential injection process because they do foam under clean conditions but are less effective with residual oil present. The results also show that the alkyl aromatic sulfonates with molecular weights above about 450 are useful for the first step of the sequential injection process since they do provide a rapid pressure increase with residual oil.

TABLE 6

STEEL WOOL FOAM TESTS
Oil Sensitive and Oil Tolerant Foaming Agents

| Sample | Carbon No. Range/Mole Wt. | Relative Response Rate clean | Relative Response Rate residual oil | Relative Pressure Increase clean | Relative Pressure Increase residual oil |
|---|---|---|---|---|---|
| AOSD | — | 5 | 1 | 1.0 | 1.0 |
| 1618 AOS | $C_{16}$–$C_{18}$ | 5 | — | 0.5 | 0.1 |
| 2024 AOS | $C_{20}$–$C_{24}$ | 5 | 0 | 1.0 | 0 |
| LABS | 347 | 0 | 0 | 0 | 0 |
| BABS | 361 | 0 | 0 | 0 | 0 |
| BATS | 471 | — | 5 | — | 0.7 |
| BABS | 500 | — | 3 | — | 1.3 |

EXAMPLE IV

This example demonstrates the benefits of using AOSD or an alpha-olefin sulfonate in the second step of the sequential injection process in which an organic solvent is used in the first step to reduce the oil saturation. The foam tests were run as described in Example I. In the present example 3–4 pore volumes of toluene were used in the first step to reduce the residual oil level in the steel wool pack. Table 7 shows that AOSD and AOS were very effective for developing a pressure increase when they were used in the second step of the sequential injection process but were not effective without the first step toluene prewash.

TABLE 7

STEEL WOOL FOAM TESTS
Surfactants Following Solvent

| Sample | Relative Response Rate no pre-wash | Relative Response Rate toluene pre-wash | Relative Pressure Increase no pre-wash | Relative Pressure Increase toluene pre-wash |
|---|---|---|---|---|
| AOSD | 1 | 6 | 1 | 1.4 |
| 1618 AOS | — | 6 | 0.1 | 1.4 |

TABLE 7-continued

| STEEL WOOL FOAM TESTS Surfactants Following Solvent | | | | |
|---|---|---|---|---|
| | Relative Response Rate | | Relative Pressure Increase | |
| Sample | no pre-wash | toluene pre-wash | no pre-wash | toluene pre-wash |
| 2024 AOS | 0 | 2 | 0 | 1.3 |

I claim:

1. A method of enhanced recovery of oil from a petroleum reservoir comprising:

injecting into said reservoir an oil-mobilizing agent comprising a gas and a surfactant, which agent is capable of mobilizing oil present in oil-bearing formation in said reservoir, in an amount sufficient to reduce the oil concentration in said oil-bearing formation;

stopping the injection of the oil-mobilizing agent; and injecting into said formation steam and an alpha-olefin sulfonate dimer surfactant or an alpha-olefin sulfonate surfactant sufficient to form a foam in areas of reduced oil concentration and thereby divert steam from said areas to areas of said oil-bearing formation having higher oil concentration and thereby assisting in the movement of oil through said formation and in the recovery of hydrocarbons from said reservoir.

2. A method according to claim 1 wherein the gas comprises steam, nitrogen, methane, flue gas, carbon dioxide, carbon monoxide or air.

3. A method according to claim 1 wherein the oil-mobilizing surfactant comprises an alkyl aromatic sulfonate having an equivalent weight of at least about 400.

4. A method according to claim 3 wherein the alkyl aromatic sulfonate comprises a benzene or toluene sulfonate having an equivalent weight of from about 450 to about 600.

5. A method according to claim 1 wherein the alpha-olefin sulfonate dimer or alpha-olefin sulfonate surfactant comprises from about 0.01% to about 10% of the water phase of the steam injected with the surfactant.

6. A process according to claim 5 wherein the alpha-olefin sulfonate dimer surfactant is in the range of about C10 to C48.

7. A process according to claim 5 wherein the alpha-olefin sulfonate surfactant is in the range of about C16 to C24.

8. A method of enhanced recovery of oil from a petroleum reservoir comprising:

injecting into said reservoir a gas and an alkyl aromatic sulfonate containing straight or branched chain alkyl group having at least 18 carbon atoms and having a molecular weight of at least 450 g/eq;

stopping the injection of the gas and alkyl aromatic sulfonate; and injecting steam and an alpha-olefin sulfonate or an alpha-olefin sulfonate dimer surfactant into said formation to form a foam-steam drive medium in said formation to assist the movement of hydrocarbons through to from said formation.

9. A method according to claim 8 wherein the gas injected with the alkyl aromatic sulfonate comprises steam, nitrogen, methane fuel gas, carbon dioxide, carbon monoxide or air.

10. A method according to claim 9 wherein the alkyl aromatic sulfonate comprises an alkyl group having from 20 to 24 carbon atoms 11. A method according to claim 8 wherein the dimer comprises from about 0.01% to about 10% of the water phase of the steam injected with the dimer.

12. A method according to claim 11 wherein the alpha-olefin sulfonate dimer includes such dimer in the range of C10–to Cphd 48.

13. A method according to claim 12 wherein said dimer is in the range of C22 to C40.

14. A method of enhanced recovery of oil from a petroleum reservoir comprising:

injecting into said reservoir an oil-mobilizing agent comprising a gas and a surfactant, which agent is capable of mobilizing oil present in oil-bearing formation in said reservoir, in an amount sufficient to reduce the oil concentration in said oil-bearing formation;

stopping the injection of the oil-mobilizing agent; and injecting into said formation steam and an oil-sensitive steam foam blocking surfactant which is effective in foaming in oil-bearing formation having less than about 15% pore volume oil concentration in an amount sufficient to form a foam in areas of reduced oil concentration and thereby divert steam from said areas to areas of said oil-bearing formation having higher oil concentration thereby assisting in the movement of oil through said formation and in the recovery of hydrocarbons from said reservoir.

* * * * *